United States Patent [19]

Olioso

[11] Patent Number: 4,630,565

[45] Date of Patent: Dec. 23, 1986

[54] EQUIPMENT FOR UNIFORMLY SPREADING ANTI-STICKING POWDERS ON BITUMINOUS MEMBRANES FOR BUILDING COVERINGS

[75] Inventor: Silvio Olioso, Castel d'Azzano, Italy

[73] Assignee: Index S.p.A. Technologie Impereabili, Italy

[21] Appl. No.: 819,900

[22] Filed: Jan. 16, 1986

[30] Foreign Application Priority Data

Dec. 13, 1985 [IT] Italy ..... 84975 A/85

[51] Int. Cl.[4] ..... B05C 3/172; B05C 11/06

[52] U.S. Cl. ..... 118/47; 118/63; 118/118; 118/407

[58] Field of Search ..... 118/407, 47, 63, 102, 118/118

[56] References Cited

U.S. PATENT DOCUMENTS 2,741,215 4/1956 Cady et al. ..... 118/118 X 3,177,847 4/1965 Schnierlein ..... 118/407

4,259,006 3/1981 Phillips et al. ..... 118/63

*Primary Examiner*—John P. McIntosh

*Attorney, Agent, or Firm*—Darby & Darby

[57] ABSTRACT

The present invention pertains to an equipment adapted to uniformly spread anti-sticking powders, such as talc in an aqueous suspension, on bituminous membranes for water-repellent coverings in the building field. Said equipment comprises a series of rollers on which the membrane runs. During the feed motion the membrane passes through a suspension-applying station and a drying station. Downstream of the suspension-applying station, a flattened jet of compressed air eliminates the liquid in excess and creates a homogeneous liquid film on the membrane. Afterwards, the membrane reaches a rotating drum provided with suitably disposed shaped reliefs which, on the membrane itself, create a homogeneous distribution of the particles suspended in the liquid film.

6 Claims, 2 Drawing Figures

EQUIPMENT FOR UNIFORMLY SPREADING ANTI-STICKING POWDERS ON BITUMINOUS MEMBRANES FOR BUILDING COVERINGS

FIELD OF THE INVENTION

The present invention relates to an equipment for uniformly spreading anti-sticking powders on bituminous membranes used for accomplishing water-repellent coverings in the building field.

BACKGROUND OF THE INVENTION

It is known that, due to stockage and transport necessities, the bituminous membranes in question are delivered in the form of rolls that are subsequently unwound by the users at the moment of their laying down.

In order to avoid undesirable glueing phenomena between two coils in a roll, due to the nature of the material (mainly consisting of bitumen), before the rolling step the membranes are coated with appropriate anti-sticking powders.

The application of said anti-sticking powders is carried out only on one side of the membrane (that is the one that during the laying step is turned outwardly) while the other side (the one in contact with the laying surface) is coated with a protective plastic film.

The anti-sticking powders applied on the membrane may be of various types. However the most preferred ones are mineral powders and, among them, talc powder which exhibits the best anti-sticking characteristics.

It is known that the currently-used methods for spreading powders on membranes can substantially be divided into dry methods and wet methods.

The application of powders using a dry method is carried out by means of appropriate vibrating nets that, being loaded with the powders, execute the spreading thereof on the underneath continuously running membrane which is transferred on rotating rollers.

This method however has some drawbacks. First of all it causes pollution in the work environment due to the dispersion of the powders in the air and furthermore it does not allow a homogeneous and optimum spreading of the powders themselves on the membrane. The pollution problem can be partially solved by the use of strong aspirators, which however results in a disadvantage from an economical point of view owing to the construction costs of the aspirators that evidently adversely affect the cost of the finished product.

The dry method used in order to obviate the above mentioned pollution problem provides the application of powders in an aqueous suspension. The application of the aqueous suspension on both sides of the membrane (obviously if the use of the protective plastic film is not provided) is carried out plunging the membrane itself into a suitable bath followed by a drying step which can be achieved by causing the membrane to move forward on entraining rollers for a given time.

Should the application of said suspension be needed only on one side of the membrane, said membrane is kept in a vertical position and caused to move in contact with and along a horizontal cylinder transverse thereto. The area disposed above the cylinder and defined by the cylinder itself and by the moving membrane is flooded with the aqueous suspension so that the aqueous suspension itself is distributed on the membrane surface in contact with the cylinder. As in the previous case, this step is followed by a drying step.

It is known that in both cases, however, it is not possible to reach the optimum spreading of the powders on the membrane. In fact, before and after the drying steps said powders tend to gather on preferential and rather broad areas threby creating other wide areas that, being unconcerned with the anti-sticking powders, give rise to the localized glueing of the roll coils.

OBJECT

The main object of the present invention is therefore to obviate the above mentioned drawbacks relative to the hitherto known art by providing an equipment for spreading anti-sticking powders on bituminous membranes which allows the accomplishment of a perfectly homogeneous and excellent spreading of the powders themselves on the membrane and which also has a low construction and operative cost.

SUMMARY OF THE INVENTION

The foregoing and still further objects are attained by the equipment of the present invention, of the kind using anti-sticking powders in an aqueous suspension and comprising a series of rotating rollers on which the bituminous membrane provided with a continuous feed motion runs and further comprising a station in which the aqueous suspension is applied to the membrane as well as a drying station and wherein, downstream of the suspension-applying station and upstream of the drying station relative to the membrane feed direction, provision is made for a rotating drum on which the membrane runs said rotating drum having its cylindrical surface disposed in contact with said membrane, provided with shaped reliefs and wherein, downstream of the suspension-applying station and upstream of said rotating drum provision is also made for a compressed air duct placed in the vicinity of the membrane transversely to the feed direction of the latter and provided with a longitudinal slit turned toward the membrane surface so that it generates a flattened air jet adapted to eliminate the liquid in excess on the membrane and to form a liquid film thereon.

BRIEF DESCRIPTION OF THE DRAWINGS

Further features and advantages of the invention will become more apparent from the following detailed description of a preferred embodiment given by way of non-limiting example in the accompanying drawings, in which.

DESCRIPTION OF THE PREFERRED EMBODIMENT

Figure 1:
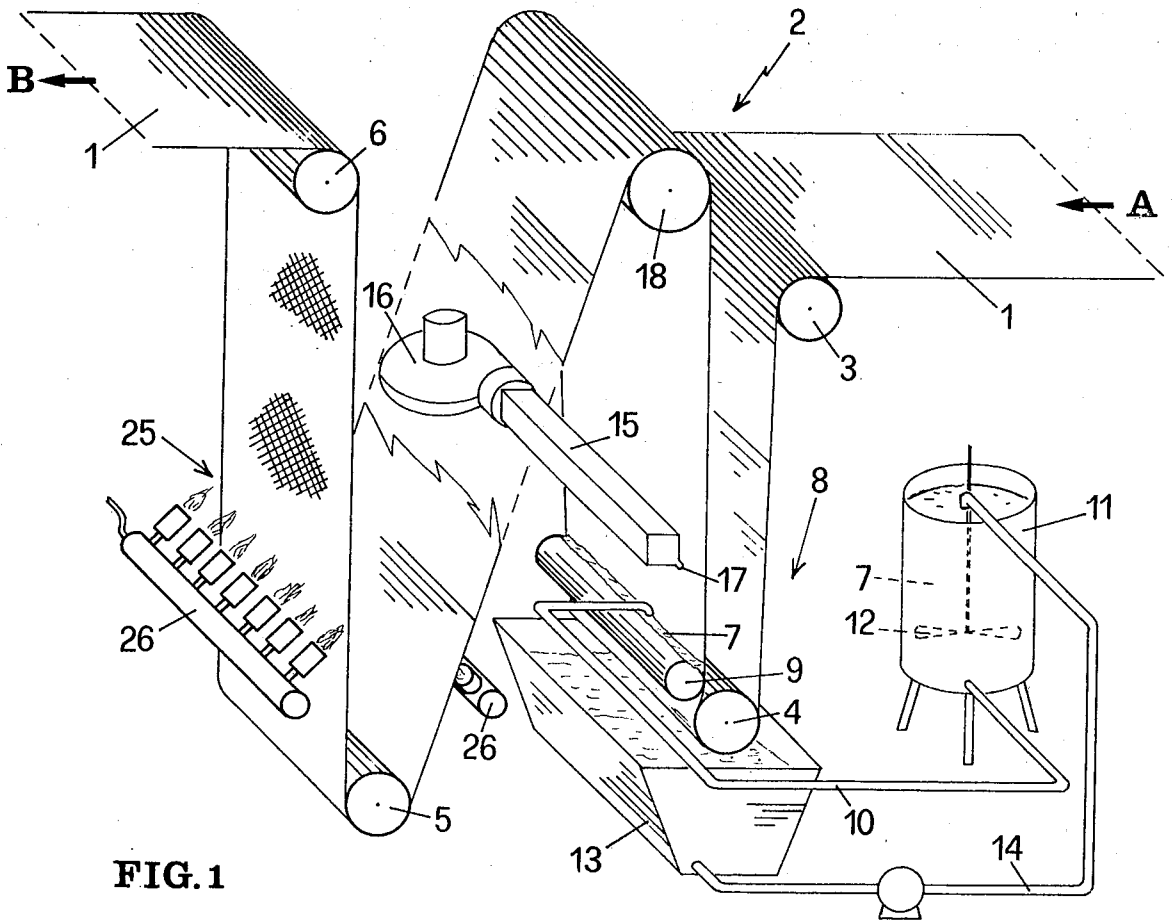
FIG. 1 is an axonometric diagrammatic view of the equipment in question.

Referring to the drawings, it has been indicated at 1 a bituminous membrane for building coverings. Said membrane 1, which is provided with a continuous feed motion according to the direction shown by the arrows in the figures, comes from the manufacturing station A and is sent to the final station B where it is wound into rolls.

On its way from A to B it passes through the equipment of the invention globally identified at 2 where the application and spreading of the anti-sticking powders on one of the sides thereof take place.

The equipment 2 comprises a series of rotating rollers 3, 4, 5 and 6 (which can be idler or powered rollers in accordance with requirements) disposed at different heights so that the membrane passing thereon may follow the route shown in FIG. 1.

The application of the anti-sticking powder takes place by wet process, using the aqueous suspension 7 (talc powder mixed with water) in the application station 8.

In such a station 8 the membrane 1 is ketp in a substantially vertical position by virtue of the presence of the idler roller 4 and is caused to slide being in contact with a horizontal cylinder 9. The area above the cylinder 9 defined by the cylinder 9 itself and by the membrane 1 is flooded with the suspension 7 coming from a feed piping 10 connected to a tank 11 which is provided with a mixer 12.

At the ends of the cylinder 9 the suspension 7 overflows into an underneath reception basin 13 connected to the tank 11 by a recycle piping 14.

The surface of the membrane 1 downstream of the cylinder 9 is therefore covered with the water suspension 7.

In traditional equipments, this suspension-applying step is immediately followed, as already mentioned, by a drying step during which the membrane 1 is caused to run on entraining rollers, over a predetermined lapse of time, along a path of suitable length.

In the equipment 2 in question, the suspension-applying step is followed by a further step during which the anti-sticking powders are uniformly spread.

Downstream of station 8, close to the membrane 1 there is a compressed air duct 15 connected to a blower. Said duct 15, disposed transversely to the feed direction of the membrane 1, has a quadrangular section (but obviously any section can suit the purpose) and is provided, on its corner turned towards the membrane 1, with a slit 17 adapted to create a flattened air jet designed for eliminating the excess liquid present on the membrane 1 itself. By effect of the flattened air jet, a liquid film rich in suspended talc particles is left on the membrane 1.

Downstream of the compressed air duct 15 provision is made for a rotating drum 18 on which the membrane 1 is partially wound. The cylindrical surface of the drum 18 is provided with many shaped small reliefs 19 each of them exhibiting a substantially flat top 20 (actually it is a slightly convex top having a bending radius equal to one half of the nominal diameter of the drum section). Said reliefs 19 are of substantially rhomboidal form and are defined by grooves 21 extending in a crossed helical manner (see FIG. 2), obtained on the cylindrical surface of the drum 18.

The rolling of the membrane 1 on the drum 18 results in the formation, on the surface of the membrane 1 itself, of a particular configuration and distribution of the talc particles present in the liquid film. Such distribution is shown on the surface of the membrane 1 seen in FIG. 2.

By examining each impression corresponding to the action exerted by each relief 19 on the liquid film present on the membrane 1, it is possible to notice three distinct talc-distribution areas: a first dark area 22 almost devoid of talc particles and substantially in the form of a C; a second white area 23 of circular form, rich in solid particles; a third grey area 24 in the form of rectilinear perimeter segments, in which an intermediate amount of talc is present.

The second area 23 is produced by effect of the surface tension of the liquid which, as the membrane 1 detaches from the top 20 of the relief 19, gives rise to the formation of a small drop (thence the circular form). The formation of said drop is achieved by removal of liquid from the surrounding area and particularly from the second area 22 which therefore is left almost devoid of liquid and consequently, as already said, of talc particles.

The third area 24, on the contrary, corresponds to the position of the grooves 21 which, as they do not come in contact with the surface of the membrane 1, leave the distribution of the liquid film unchanged.

Afterwards, downstream of the drum 18 the membrane 1 passes through a drying station 25 consisting of a pair of burner sets 26 aligned transversely to the same and disposed upstream and downstream of the roller 5 respectively, which burners allow a quick evaporation of the liquid film present on the membrane 1.

Figure 2:
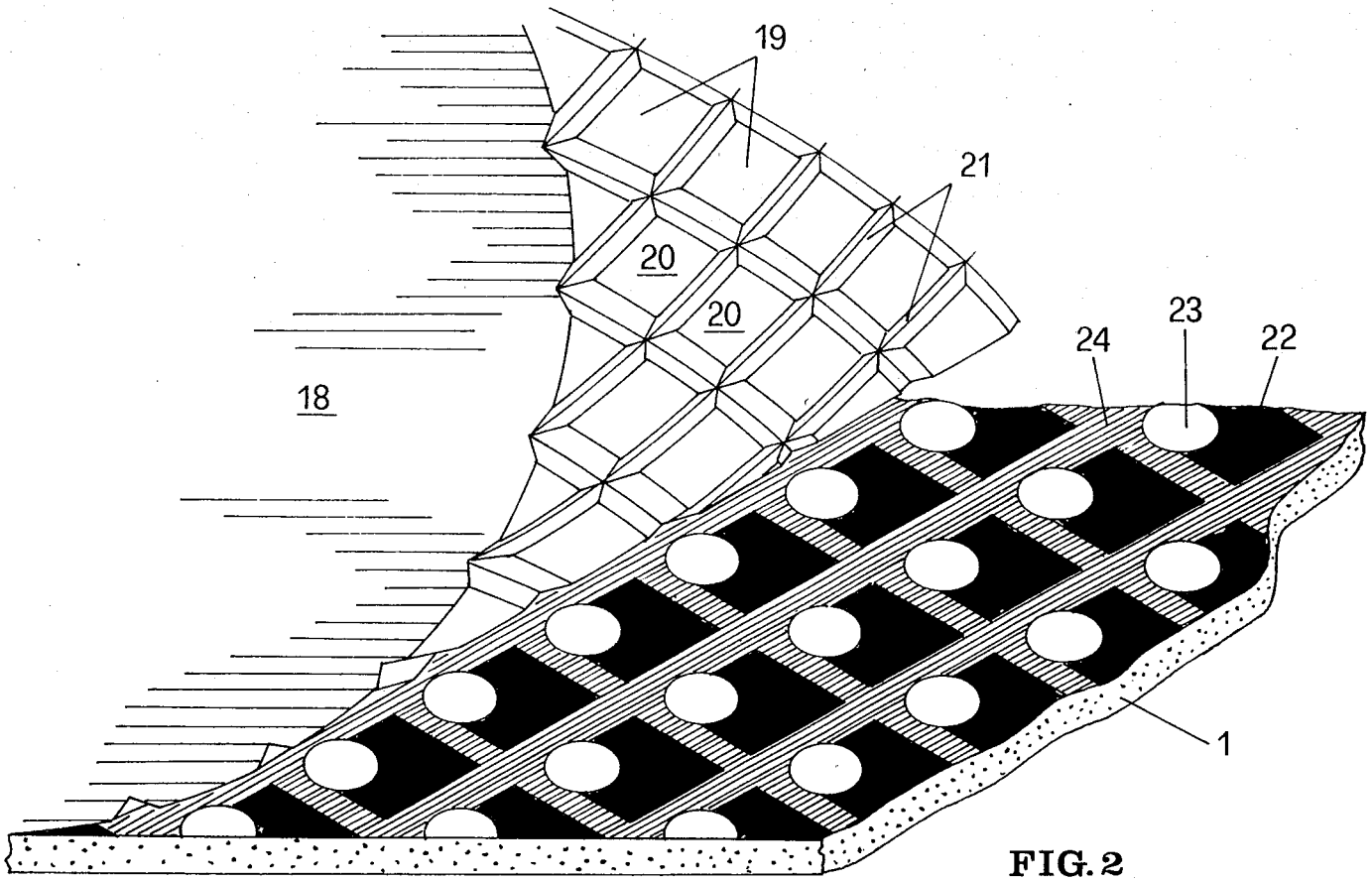
FIG. 2 is an axonometric diagrammatic view of part of the rotating drum and part of the membrane being unrolled therefrom.

Downstream of the drying station 25 the distribution of the talc particles on the membrane 1 remains unchanged as seen in FIG. 2.

It is to be noted that the storage of talc particles on the second area 23 due to the greater amount of aqueous suspension stored thereon constitutes an advantage to the ends of the anti-sticking effect.

In fact, since in the long run the solid particles tend to be absorbed by the bitumen present on the surface of the membrane 1, it is important that on the surface itself areas with talc in excess should be provided and that said areas should be distributed as homogeneously as possible.

In the case shown each area 23 has such a feature.

As a result, even if the memberane 1 should be left rolled up for long periods, the anti-sticking effect would be always ensured.

It is also to be noted that for the optimal achievement of the above described effects each top 20 of the reliefs 19 should preferably have an extension ranging from 10 to 100 $mm^2$ and each groove 21 should be 1 to 3 mm long and about 1 mm deep.

The invention attains the intended purposes.

Obviously the equipment according to the invention can, in practical forms of embodiment, also differ constructionally from what has been outlined above. Furthermore all of the details may be replaced by technically equivalent elements and the component members can be of any nature and magnitude in accordance with requirements.

What is claimed is:

1. An equipment for uniformly spreading anti-sticking powders on bituminous membranes for building coverings, of the kind using anti-sticking powders in an aqueous suspension and comprising a series of rotating rollers on which the bituminous membrane provided with a continuous feed motion runs and further comprising a station in which the aqueous suspension is applied to the membrane as well as a drying station, wherein, downstream of the suspension-applying station and upstream of the drying station relative to the membrane feed direction, provision is made for a rotating drum on which the membrane runs, said rotating drum having its cylindrical surface disposed in contact with the membrane, provided with shaped reliefs, and wherein, downstream of the suspension-applying station and upstream of said rotating drum provision is also made for a compressed air duct placed in the vicinity of the membrane transversely to the feed direction of the latter and provided with a longitudinal slit turned towards the membrane surface so that it generates a flattened air jet adapted to eliminate the liquid in excess on the membrane and to form a liquid film thereon.

2. The equipment according to claim 1, wherein said shaped reliefs are provided with substantially flat tops and are defined by grooves obtained on said cylindrical surface.

3. The equipment according to claim 2, wherein said grooves extend in a crossed helical manner and the tops of said reliefs are of substantially rhomboidal form.

4. The equipment according to claim 3, wherein each of said tops has an extension ranging from 10 to 100 $mm^2$ and each of said grooves is 1 to 3 mm long and about 1 mm deep.

5. The equipment according to claim 1, wherein said compressed air duct has a substantially quadrangular section and said slit is obtained at a corner of said section.

6. The equipment according to claim 1, wherein said drying station consists of at least a set of burners aligned transversely to the feed direction of said membrane.

* * * * *